US009366986B2

(12) United States Patent
Shimomura

(10) Patent No.: US 9,366,986 B2
(45) Date of Patent: Jun. 14, 2016

(54) DEVELOPMENT DEVICE AND IMAGE FORMATION APPARATUS

(71) Applicant: Oki Data Corporation, Tokyo (JP)

(72) Inventor: Tatsuhiko Shimomura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/187,396

(22) Filed: Feb. 24, 2014

(65) Prior Publication Data

US 2014/0241760 A1 Aug. 28, 2014

(30) Foreign Application Priority Data

Feb. 25, 2013 (JP) ..... 2013-034954

(51) Int. Cl.
*G03G 15/08* (2006.01)

(52) U.S. Cl.
CPC ..... *G03G 15/0808* (2013.01)

(58) Field of Classification Search
USPC ..... 399/287
See application file for complete search history.

(56) References Cited

U.S. PATENT DOCUMENTS 5,300,987 A * 4/1994 Aoyama et al. ..... 399/96
5,471,286 A * 11/1995 Tanaka ..... 399/167
5,812,917 A * 9/1998 Iwata ..... G03G 15/0808 399/272
5,839,021 A * 11/1998 Hayashi et al. ..... 399/55
7,218,881 B2 * 5/2007 Tanaka ..... 399/269
2011/0097097 A1 * 4/2011 Eom ..... 399/55
2012/0134722 A1 * 5/2012 Sasaki et al. ..... 399/269
2012/0189355 A1 * 7/2012 Mitsunobu ..... G03G 15/0808 399/258
2012/0230734 A1 * 9/2012 Shimizu et al. ..... 399/254

FOREIGN PATENT DOCUMENTS

JP H06-175487 A 6/1994
JP H08-137223 A 5/1996
JP H10-039628 A 2/1998
JP H10-78693 A 3/1998

* cited by examiner

*Primary Examiner* — Clayton E Laballe
*Assistant Examiner* — Linda B Smith
(74) *Attorney, Agent, or Firm* — Mots Law, PLLC

(57) ABSTRACT

A development device includes a developer carrier, a restriction member to control a layer thickness of the developer on the developer carrier, first and second developer supply members being in contact with the developer carrier. Each of the developer supply members is configured to rotate at a speed having a constant ratio to a rotation speed of the developer carrier. The second developer supply member and the restriction member are arranged in this order downstream of the first developer supply member in a rotating direction of the developer carrier. A peripheral speed (a speed of the outer peripheral surface) of the second developer supply member is set to be slower than that of the first developer supply member.

23 Claims, 3 Drawing Sheets

DEVELOPMENT DEVICE AND IMAGE FORMATION APPARATUS

CROSS REFERENCE TO RELATED APPLICATIONS

This application claims priority based on 35 USC 119 from prior Japanese Patent Application No. 2013-034954 filed on Feb. 25, 2013, entitled "DEVELOPMENT DEVICE AND IMAGE FORMATION APPARATUS", the entire contents of which are incorporated herein by reference.

BACKGROUND OF THE INVENTION

1. Field of the Invention

This disclosure relates to a development device and an image formation apparatus which develop and visualize an electrostatic latent image formed on a photosensitive drum.

2. Description of Related Art

Among conventional image formation apparatuses, there are image formation apparatuses which supply a developer to a developer carrier by using two developer supply members (for example, see Patent Document 1: Japanese Patent Application Publication No. Hei 10-39628).

SUMMARY OF THE INVENTION

When using conventional techniques, an image quality deteriorates in some cases. An object of one embodiment of the invention is to improve the image quality.

An aspect of the invention is a development device that includes: a developer carrier configured to carry a developer; a restriction member configured to restrict a layer thickness of the developer carried on a surface of the developer carrier; and first and second developer supply members being in contact with the developer carrier with each configured to rotate at a speed having a constant ratio to a rotation speed of the developer carrier. The second developer supply member and the restriction member are arranged in this order downstream of the first developer supply member in a rotating direction of the developer carrier, and a peripheral speed (a speed of the outer peripheral surface) of the second developer supply member is set to be slower than that of the first developer supply member.

Another aspect of the invention is a development device that includes: a developer carrier configured to carry a developer; a restriction member configured to restrict a layer thickness of the developer carried on a surface of the developer carrier; and first and second developer supply members being in contact with the developer carrier and each configured to rotate at a speed having a constant ratio to a rotation speed of the developer carrier. The second developer supply member and the restriction member are arranged in this order downstream of the first developer supply member in a rotating direction of the developer carrier, and a contact area of the second developer supply member with the developer carrier is set to be smaller than a contact area of the first developer supply member with the developer carrier.

According to these aspects, the image quality can be improved.

DETAILED DESCRIPTION OF EMBODIMENTS

Figure 1:
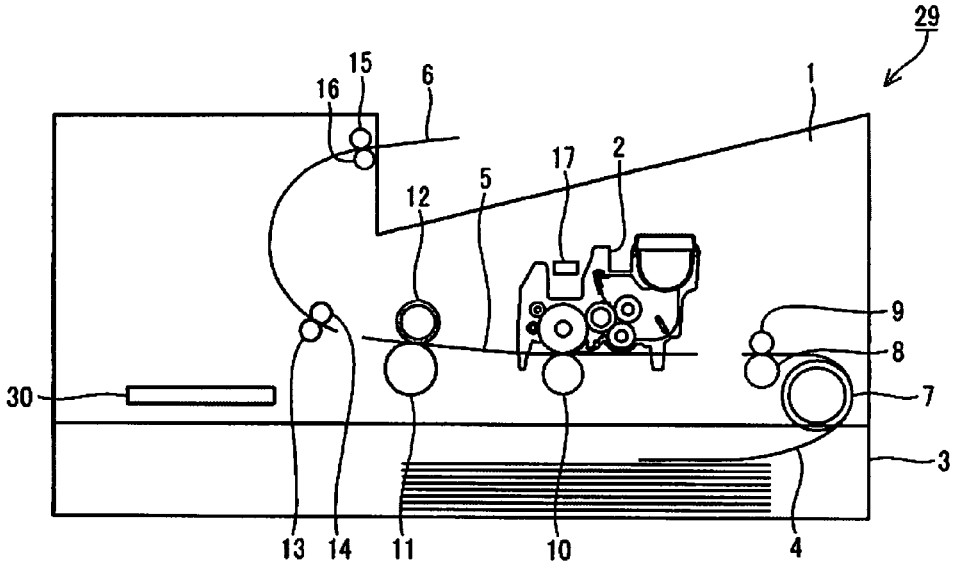
FIG. 1 is an explanatory view illustrating a configuration of an image formation apparatus in a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiments of a development device and an image formation apparatus of the invention are described below with reference to the drawings.

Embodiment 1

FIG. 1 is an explanatory diagram illustrating a configuration of the image formation apparatus in a first embodiment. In FIG. 1, image formation apparatus 29 is a printer and includes image formation apparatus case 1, development unit 2, cassette 3, hopping roller 7, registration rollers 8, 9, transfer member 10, back-up roller 11, heat roller 12, discharge rollers 13, 14, 15, 16, exposure unit 17, and control board 30. Note that development unit 2 is described later in detail.

Print medium 4 is a print medium in a state of being sent from cassette 3 by a paper feed mechanism and a paper sending mechanism including hopping roller 7 and registration rollers 8, 9. Print medium 5 is a print medium in a state where a toner being a developer is transferred thereon by development unit 2 and transfer member 10. The toner is fixed to the print medium by a fixation unit including back-up roller 11 and heat roller 12. Print medium 6 is a print medium in a state of being discharged by discharge rollers 13, 14, 15, 16 with the toner fixed thereto.

Figure 2:
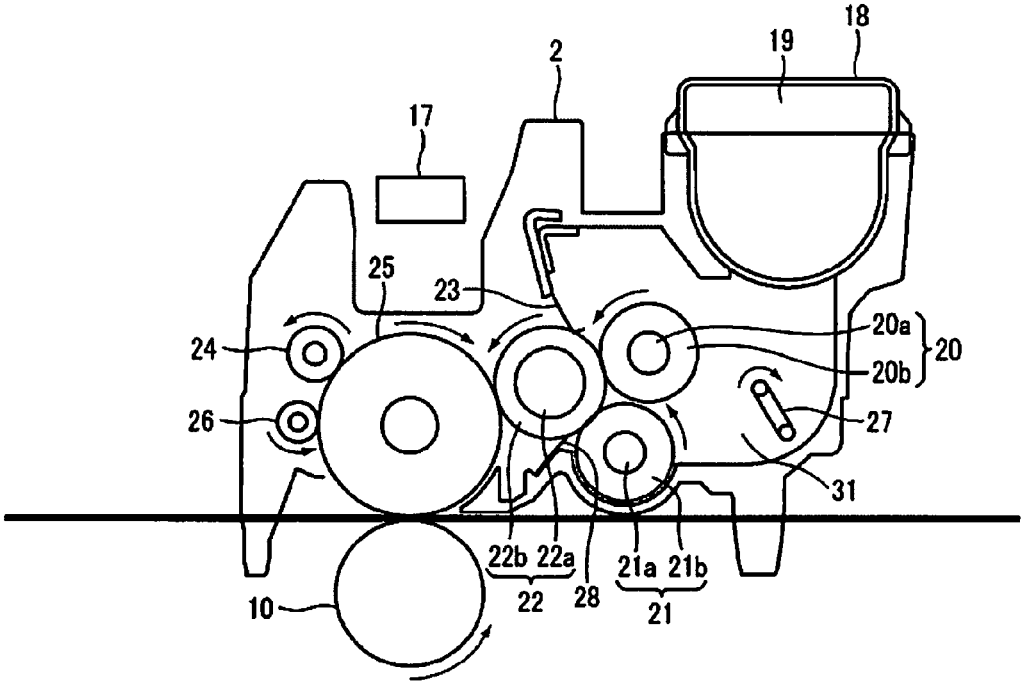
FIG. 2 is an explanatory view illustrating a configuration of a development unit in the first embodiment

FIG. 2 is an explanatory view illustrating a configuration of the development unit in the first embodiment and illustrates a portion around development unit 2 of FIG. 1 in an enlarged manner. In FIG. 2, development unit 2 which is the development device includes toner cartridge 18, toner storage space 19, first supply roller 21, second supply roller 20, development roller 22, blade 23, charge roller 24, photosensitive drum 25, cleaning roller 26, agitation member 27, urethane film 28, and toner holding space 31.

Toner cartridge 18 includes therein toner storage space 19 and stores the toner. Moreover, in toner cartridge 18, turning a not-illustrated lever opens a shutter of toner cartridge 18 and the toner is thereby supplied to toner holding space 31 in development unit 2. Photosensitive drum 25 includes a gear, which is a not-illustrated gear, fixedly attached to one side of a shaft. The Photosensitive drum 25 receives driving force from a not-illustrated drive unit of the image formation apparatus via the gear and thereby rotates.

First supply roller 21 which is a first developer supply member includes metal shaft 21*a* which is a conductive shaft and foam rubber layer 21*b* which is an elastic foam layer. Second supply roller 20 which is a second developer supply member includes metal shaft 20*a* which is a conductive shaft and foam rubber layer 20*b*. First supply roller 21 and second supply roller 20, which are the developer supply members, each rotate at a speed having a constant ratio to the rotation speed (number of revolutions) of development roller 22 and each comes in contact with development roller 22 to supply the toner.

Moreover, in order to make first supply roller 21 and second supply roller 20 supply a charged toner to development roller 22 by using a voltage difference between development roller 22 and each of the rollers, a not-illustrated high-voltage power source applies a voltage to each of the rollers. Development roller 22 is a developer carrier carrying the toner which is the developer, and includes metal shaft 22*a* which is a conductive shaft and rubber layer 22*b* which is an elastic layer. Development roller 22 receives driving force from a not-illustrated drum gear by using a not-illustrated gear fixedly attached to the shaft and thereby rotates.

Moreover, the gear of development roller 22 and a not-illustrated gear fixedly attached to the shaft of first supply roller 21 are connected to each other via a not-illustrated idle gear. Furthermore, the gear of first supply roller 21 is connected to a not-illustrate gear fixedly attached to the shaft of second supply roller 20 via a not-illustrated idle gear. Agitation member 27 has a crank shape. A not-illustrated gear fixedly attached to an end portion of agitation member 27 is directly connected to second supply roller 20 to be driven. Agitation member 27 thus agitates the toner in toner holding space 31 and supplies the toner to the first and second supply roller side.

Urethane film 28 is in contact with development roller 22 to prevent the toner in toner holding space 31 from escaping to the outside. Blade 23 which is a restriction member is a thin SUS (Steel Use Stainless) plate and is bent in a front end portion thereof. Blade 23 restricts the layer thickness of the toner carried on a surface of development roller 22. The toner supplied to development roller 22 by first supply roller 21 and second supply roller 20 is formed into a thin layer of toner on the surface of development roller 22 by blade 23.

Charge roller 24 uniformly charges a surface of photosensitive drum 25. Exposure unit 17 selectively exposes the surface of photosensitive drum 25 charged by charge roller 24 to light and forms an electrostatic latent image. Development roller 22 described above develops the electrostatic latent image. Transfer member 10 transfers the electrostatic latent image to print medium 5 sent from cassette 3 by the paper feed mechanism and the paper sending mechanism which include hopping roller 7 and registration rollers 8, 9 illustrated in FIG. 1.

Cleaning roller 26 cleans the toner which remains on photosensitive drum 25 without being transferred. The fixation unit, including back-up roller 11 and heat roller 12 illustrated in FIG. 1, fixes the toner to print medium 5. Print medium 6, illustrated in FIG. 1 and to which the toner is fixed, is discharged by discharge rollers 13, 14, 15, 16.

Control board 30 illustrated in FIG. 1 is disposed in image formation apparatus 29 and controls the print operations of the component members of image formation apparatus 29 described above. Moreover, the rotating directions of the respective rotation members are such that, as indicated by the arrows in the drawing, the rotating directions of photosensitive drum 25 and agitation member 27 are clockwise in the drawing while the rotating directions of development roller 22, first supply roller 21, second supply roller 20, cleaning roller 26, charge roller 24, and transfer member 10 are counterclockwise in the drawing.

Development roller 22, charge roller 24, and cleaning roller 26 each rotate while coming in contact with photosensitive drum 25 at a specified press force. A development method in which development roller 22 comes in contact with photosensitive drum 25 as described above is referred to as a contact development method. Moreover, first supply roller 21 and second supply roller 20 each rotate while coming in contact with development roller 22 at a specified press force and second supply roller 20 and blade 23 are arranged in this order downstream of first supply roller 21 in the rotating direction of development roller 22.

Next, actions of the configuration described above are described. Table 1 describes the outer diameter and the number of gear teeth of each of photosensitive drum 25, development roller 22, first supply roller 21, and second supply roller 20 in the first embodiment as well as the rotation speed ratio and the peripheral speed ratio thereof to the rotation speed and the peripheral speed (moving distance of an outer peripheral surface per unit of time) of photosensitive drum 25, provided that the rotation speed and the peripheral speed of photosensitive drum 25 are taken as 1. Moreover, in Table 1, a description is given of two gears for each of development roller 22 and first supply roller 21 because the gears of development roller 22 and the gears of first supply roller 21 have a two-stage gear configuration. Note that each of the two gears, whose numbers of teeth are described to be close to each other, are connected to each other via the corresponding idle gear as described above. However, since the idle gears do not affect the rotation speed ratio, no description thereof is given in the embodiment.

TABLE 1

| | Outer diameter (mm) | Number of gear teeth | Rotation speed ratio | Peripheral speed ratio |
|---|---|---|---|---|
| Photosensitive drum 25 | 30.0 | 38 | 1.00 | 1.00 |
| Development roller 22 | 15.9 | 16<br>15 | 2.38 | 1.26 |
| First supply roller 21 | 14 0 | 22<br>20 | 1.62 | 0.76 |
| Second supply roller 20 | 14.0 | 30 | 1.08 | 0.50 |

In the contact development method described in the embodiment, in order to obtain a predetermined print density in printing, i.e. in order to develop a predetermined amount of toner on photosensitive drum 25, various parameters are set in such a way that a predetermined amount of toner is obtained on a portion of development roller 22 having passed blade 23. The parameters include various characteristics of each of the rollers. Such characteristics include toner charging characteristics, surface roughness, resistance value, and surface finishing. Other characteristics include a restricting force of blade 23 which is determined from a material, a plate thickness R of a bent portion, a distance from a supporting point, and high-voltage values which are voltages applied to the respective rollers; and the like. Furthermore, in the contact development method, since the triboelectric charging of the toner in a rotating body contact friction portion between the development roller and the supply rollers has a great effect, the parameter settings of the rotation speed and the peripheral speed of each of the members described in Table 1 are also important.

Obtaining values of these settings from a required amount of toner on development roller 22 by back calculation is difficult. The values are thus determined by actually performing an evaluation and measurement. In Table 1, the peripheral speed of second supply roller 20 which is close to blade 23 in the embodiment is set to be slower than that of first supply roller 21. This setting can reduce friction caused by the contact friction between second supply roller 20 and development roller 22. Accordingly, it is possible to reduce the possibility that a wear fragment of second supply roller 20 generated by the friction is caught between blade 23 and development roller 22.

Table 2 describes the results of a determination on whether a white stripe is present or absent, and a determination on whether the density is good or not good in cases where the peripheral speed of first supply roller 21 and the peripheral speed of second supply roller 20 are changed. The results are those of the first embodiment (Example 1) and two Comparative Examples (Comparative Examples 1, 2). Here, the white stripe in the embodiment is a defect phenomenon in printing described as follows. A wear fragment of second supply roller 20 is caught between blade 23 and development roller 22 and the caught wear fragment scrapes away the toner layer on development roller 22, thereby forming a linear portion on the print medium to which no toner is transferred.

A continuous evaluation is used as the determination method in Table 2 and the evaluation is performed with the sheet size set to the A4 size, the print pattern set to a dot pattern occupying 1% of the entire printable area, and the number of printed copies set to twenty thousand copies. The method of determining the presence and absence of the white stripe is performed visually. The density is measured by using a spectrodensitometer model X-Rite 528 (manufactured by X-Rite, Incorporated). Note that the criteria for the density are such that 1.3 (abstract number) or more is "good" and less than 1.3 (abstract number) is "not good". Moreover, the peripheral speed of photosensitive drum 25 is set to 313 (mm/s).

TABLE 2

| | Peripheral speed of first supply roller 21 (mm/s) | Peripheral speed of second supply roller 20 (mm/s) | White stripe | Density |
|---|---|---|---|---|
| Example 1 | 238 | 157 | Absent | Good |
| Comparative Example 1 | 207 | 207 | Present | Good |
| Comparative Example 2 | 189 | 189 | Absent | Not good |

In Example 1 described in Table 2, a load applied to second supply roller 20 is reduced by setting the peripheral speed of second supply roller 20 slower than the peripheral speed of first supply roller 21 and a wear fragment is less likely to be generated; thus no generation of the white stripe is recognized and the density is determined to be good. In Comparative Example 1, the peripheral speeds of both of first supply roller 21 and second supply roller 20 are set to be fast. Accordingly, a load applied to second supply roller 20 is large and a wear fragment is likely to be generated; thus a wear fragment generated from second supply roller 20 is caught between blade 23 and development roller 22 and generation of the white stripe is thereby recognized. Note that, since the supply of the toner is sufficient, the density is determined to be good.

In Comparative Example 2, the peripheral speeds of both supply rollers, which are first supply roller 21 and second supply roller 20, are set to be slow. Accordingly, a load applied to second supply roller 20 is small and a wear fragment is less likely to be generated. Thus, no generation of the white stripe is recognized. However, since the supply of the toner is insufficient, the density is determined to be not good.

As described above, in the case of disposing the two supply rollers 20, 21 for development roller 22, the peripheral speed of second supply roller 20 disposed close in distance to blade 23, which is configured to restrict the layer thickness of the toner on development roller 22, is set to be slower than the peripheral speed of the other first supply roller 21. This setting can reduce the possibility that a wear fragment of second supply roller 20 is caught between blade 23 and development roller 22 and the white stripe in the printing is thereby generated. Furthermore, this setting can increase the life of development unit 2.

Note that, due to this setting, the triboelectric charging of the toner, the amount of toner supplied to development roller 22, and a scraping amount of the toner on development roller 22 in second supply roller 20 are set to be lower in performance than those in first supply roller 21. However, since the amount of toner on development roller 22 needs to be set within a predetermined range, as the combined total of the amounts of toner supplied by first supply roller 21 and second supply roller 20, the amount of toner supplied to development roller 22 can be supplemented by setting the peripheral speed of the other supply roller 21 to a faster speed.

As described above, in the first embodiment, the peripheral speed of the second supply roller is set to be slower than the peripheral speed of the first supply roller in the development unit in which the second roller and the blade are arranged in this order downstream of the first supply roller in the rotating direction of the development roller. Due to this configuration, the load applied to the second supply roller is reduced and the generation of a wear fragment is thereby reduced. Accordingly, the effect obtained is that it is possible to reduce the possibility of generation of the white stripe in printing which is caused by a wear fragment of the second supply roller caught between the blade and the development roller, and to thereby improve the image quality.

Embodiment 2

Figure 3:
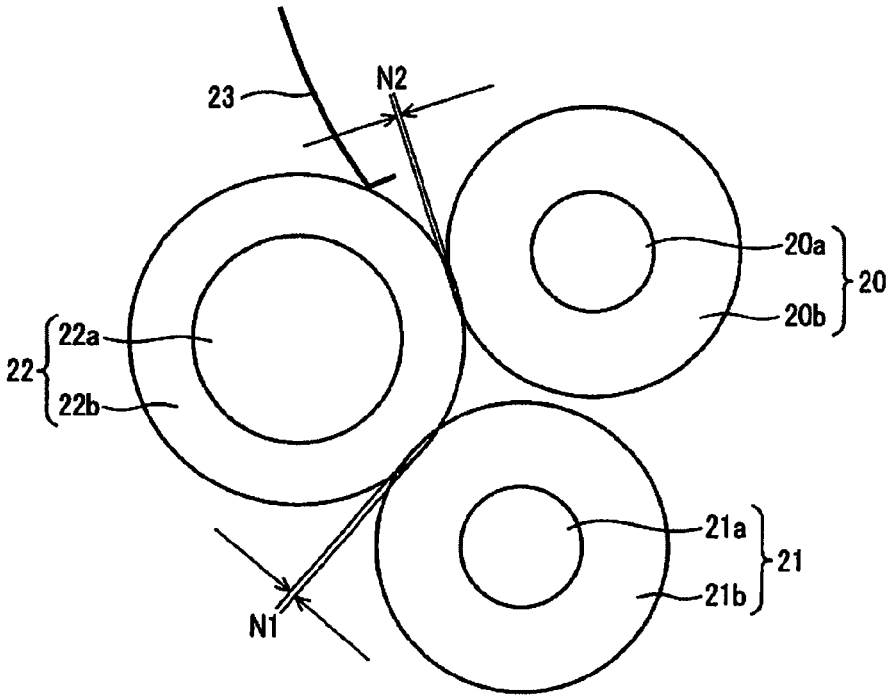
FIG. 3 is an explanatory view illustrating a first supply roller, a second supply roller and press amounts of a development roller in a second embodiment.

FIG. 3 is an explanatory diagram illustrating a first supply roller, a second supply roller, and press amounts of a development roller in a second embodiment. Note that parts similar to those of the first embodiment described above are denoted by the same reference numerals and descriptions thereof are omitted. In FIG. 3, the rotation speed and the peripheral speed of each of the rotation members are set to values described in Table 3 in the second embodiment. Moreover, the value of press amount N1 of first supply roller 21 against development roller 22, and the value of press amount N2 of second supply roller 20 against development roller 2, satisfy N1=N2 in the first embodiment, but satisfy N1>N2 in the second embodiment. Specifically, the values are set to satisfy N1=0.6 (mm) and N2=0.4 (mm). Note that, in the first embodiment, the values are set to satisfy N1=N2=0.5 (mm).

Actions of the aforementioned configuration are described. Table 3 describes the outer diameter and the number of gear teeth of each of photosensitive drum 25, development roller 22, first supply roller 21, and second supply roller 20 in the second embodiment as well as the rotation speed ratio and peripheral speed ratio thereof to the rotation speed and the peripheral speed of photosensitive drum 25, provided that the rotation speed and the peripheral speed of photosensitive drum 25 are taken as 1.

TABLE 3

| | Outer diameter (mm) | Number of gear teeth | Rotation speed ratio | Peripheral speed ratio |
|---|---|---|---|---|
| Photosensitive drum 25 | 30.0 | 38 | 1.00 | 1.00 |
| Development roller 22 | 15.9 | 16<br>15 | 2.38 | 1.26 |
| First supply roller 21 | 14.0 | 27<br>27 | 1.32 | 0.62 |

TABLE 3-continued

| | Outer diameter (mm) | Number of gear teeth | Rotation speed ratio | Peripheral speed ratio |
|---|---|---|---|---|
| Second supply roller 20 | 14.0 | 27 | 1.32 | 0.62 |

As described above, the press amounts of the respective supply rollers against development roller 22 are set to satisfy press amount N1 of first supply roller 21=0.6 (mm) and pressing mount N2 of second supply roller 20=0.4 (mm). Accordingly, assuming that the contact width of each of the two supply rollers with development roller 22 is 216 (mm), the contact area of first supply roller 21 with development roller 22 is calculated to be 914 ($mm^2$) and the contact area of second supply roller 20 with development roller 22 is calculated to be 746 ($mm^2$). Here, the contact area of second supply roller 20 is set to be approximately 18% smaller than that of first supply roller 21.

Due to this setting, the triboelectric charging of the toner, the amount of toner supplied to development roller 22, and a scraping amount of the toner on development roller 22 in second supply roller 20 are set to be lower in performance than those in first supply roller 21. However, the amount of toner on development roller 22 is set within a predetermined range, as the combined total of the amounts of toner supplied by first supply roller 21 and second supply roller 20. Reducing the contact area of second supply roller 20 with development roller 22 reduces the wear amount of second supply roller 20 and can thus reduce the possibility of a wear fragment being generated.

In the first embodiment, the contact areas of the two supply rollers with development roller 22 are the same and the peripheral speeds thereof are different from each other. Differently in the second embodiment, the peripheral speeds of the two supply rollers are the same and the contact areas thereof with development roller 22 are different from each other. However, both of the peripheral speeds and the contact areas of the two supply rollers may be set to be different from one another. Specifically, it is possible to set the peripheral speed of second supply roller 20 slower than the peripheral speed of first supply roller 21 and to set the contact area of second supply roller 20 with development roller 22 to be smaller than the contact area of first supply roller 21 with development roller 22.

Table 4 describes the results of a determination on whether a white stripe is present or absent and a determination on whether the density is good or not good in cases where the contact area of first supply roller 21 and the contact area of second supply roller 20 are changed. The results are those of the second embodiment (Embodiment 2) and two Comparative Examples (Comparative Examples 3, 4). Note that the criteria, the measurement method, and the peripheral speed of photosensitive drum 25 are the same as those in the description of Table 2 in the first embodiment.

TABLE 4

| | Contact area of first supply roller 21 ($mm^2$) | Contact area of second supply roller 20 ($mm^2$) | White stripe | Density |
|---|---|---|---|---|
| Example 2 | 914 | 746 | Absent | Good |
| Comparative Example 3 | 914 | 914 | Present | Good |
| Comparative Example 4 | 746 | 746 | Absent | Not good |

In Example 2 described in Table 4, a load applied to second supply roller 20 is reduced by setting the contact area of second supply roller 20 smaller than the contact area of first supply roller 21 and a wear fragment is less likely to be generated. With this arrangement, no generation of the white stripe is recognized and the density is determined to be good.

In Comparative Example 3, the contact areas of both of first supply roller 21 and second supply roller 20 are set to be large and a wear fragment generated from second supply roller 20 is caught between blade 23 and development roller 22. With this arrangement, any generation of the white stripe is recognized. Note that, since the supply of the toner is sufficient, the density is determined to be good. In Comparative Example 4, the contact areas of both supply rollers which are first supply roller 21 and second supply roller 20 are set to be small and no generation of the white stripe is recognized. However, since the supply of the toner is insufficient, the density is determined to be not good.

As described above, in the case of disposing the two supply rollers 20, 21 for development roller 22, the contact area of second supply roller 20 with development roller 22 is set to be smaller than the contact area of the other supply roller 21 with development roller 22. Second supply roller 20, by being disposed close in distance to blade 23, is configured to restrict the layer thickness of the toner on development roller 22. This setting can reduce the load applied to supply roller 20 and reduce any generation of a wear fragment. This reduces the possibility that a wear fragment of second supply roller 20 is caught between blade 23 and development roller 22 which causes a white stripe to be generated in the printing. Furthermore, this setting can increase the life of development unit 2.

Moreover, the performances of supplying the toner to development roller 22 and of charging the toner by the second supply roller are adjustable within a certain range by adjusting voltages applied to the respective members. Accordingly, in the case where one or both of the rotation speed and the contact area of second supply roller 20 is set to be slower or smaller than that of first supply roller 21, the performances of second supply roller 20 can be complemented by setting a high-voltage absolute value, as a voltage value to be applied to second supply roller 20, higher than that of first supply roller 21.

A specific example is given. In a case where the toner is a negatively-charged toner, as settings of the high voltages applied in the printing, a voltage of −200 (V) is applied to development roller 22, a voltage of −300 (V) is applied to first supply roller 21, and a voltage of −400 (V) is applied to second supply roller 20. In practice, the voltage of −400 (V) is supplied from a high-voltage power source to second supply roller 20. Meanwhile, second supply roller 20 and first supply roller 21 are connected to each other at a high-voltage connection point connected to a shaft of first supply roller 21, with a Zener diode (voltage regulator diode) of 100 (V) provided therebetween. A −300 voltage (V) is thereby applied to first supply roller 21.

Specifically, first supply roller 21 and the Zener diode, which is a member configured to step down a voltage, are electrically connected to each other in series. Second supply roller 20 and a set of first supply roller 21 and the Zener diode, which are connected in series, are electrically connected to each other in parallel. Due to this configuration, the voltage applied to second supply roller 20 becomes higher than the voltage applied to first supply roller 21.

As described above, in the second embodiment, the contact area of the second supply roller with the development roller is set to be smaller than the contact area of the first supply roller with the development roller in the development unit. The two supply rollers are disposed in the development unit for the development roller. The second supply roller is disposed close to the blade configured to restrict the layer thickness of the toner on the development roller. Due to this configuration, an effect is obtained that makes it possible to reduce the possibility of generation of the white stripe in printing caused by a wear fragment of the supply roller caught between the blade and the development roller. Moreover, the toner supplying performance and the toner charging performance of the second supply roller disposed close to the blade, where the blade is configured to restrict the layer thickness of the toner on the development roller, can be complemented by setting the voltage applied to the second supply roller higher than the voltage applied to the first supply roller.

The first and second embodiments are described by taking the image formation apparatus with the replaceable toner cartridge as an example. However, the development units of the first and second embodiments can also be applied to an image formation apparatus in which the toner cartridge and the development unit are integrated with each other and the entire development unit is replaced. Moreover, the first and second embodiments are described by taking the printer as an example. However, the development units of the first and second embodiments can also be applied to, as the image formation apparatus, a facsimile apparatus, a copier, and an apparatus having multiple functions of these apparatuses.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A development device comprising:

a latent image carrier configured to carry thereon a latent image, a developer carrier configured to carry a developer thereon and supply the developer to the latent image on the latent image carrier;

a restriction member configured to restrict a layer thickness of the developer on the developer carrier; and first and second developer supply members being in contact with the developer carrier and each configured to rotate at a speed having a constant ratio to a rotation speed of the developer carrier, wherein the second developer supply member and the restriction member are arranged in this order downstream of the first developer supply member in a rotating direction of the developer carrier, and a peripheral speed of the second developer supply member is set to be slower than a peripheral speed of the first developer supply member.

2. The development device according claim 1, wherein the first and second developer supply members are configured to rotate in the same rotational direction.

3. The development device according claim 1, wherein the developer carrier is configured to rotate in a rotational direction same as those of the first and second developer supply members.

4. The development device according to claim 3, wherein the developer carrier includes a conductive shaft and an elastic layer.

5. The development device according to claim 3, wherein the developer supply members each include a conductive shaft and an elastic foam layer.

6. The development device according to claim 3, wherein a contact area of the second developer supply member with the developer carrier is set to be smaller than a contact area of the first developer supply member with the developer carrier.

7. An image formation apparatus comprising the development device according to claim 3.

8. The image formation apparatus according to claim 7, wherein the first developer supply member and the second developer supply member are each configured to receive a voltage and thereby charge the developer so as to supply the charged developer to the developer carrier by using a voltage difference between the developer carrier and the developer supply member, and the voltage applied to the second developer supply member is higher than the voltage applied to the first developer supply member.

9. The image formation apparatus according to claim 8, wherein the first developer supply member and a member configured to step down a voltage are electrically connected to each other in series and the second developer supply member and a set of the first developer supply member and the member configured to step down a voltage which are connected in series are electrically connected to each other in parallel, and the voltage applied to the second developer supply member is set to be higher than the voltage applied to the first developer supply member.

10. The image formation apparatus according to claim 9, wherein the member configured to step down a voltage is a voltage regulator diode.

11. An image formation apparatus comprising the development device according to claim 6.

12. A development device comprising:

a developer carrier configured to carry a developer thereon;

a restriction member configured to restrict a layer thickness of the developer on a surface of the developer carrier; and first and second developer supply members being in contact with the developer carrier and each configured to rotate at a speed having a constant ratio to a rotation speed of the developer carrier, wherein the second developer supply member and the restriction member are arranged in this order downstream of the first developer supply member in a rotating direction of the developer carrier, and a peripheral speed of the second developer supply member is set to be slower than a peripheral speed of the first developer supply member, wherein the development device further comprises:

a first gear for the developer carrier;

a second gear for the first developer supply member;

a third gear for the second developer supply member; and idle gears, wherein the first, second, and third gears are connected with one another via the idle gears, wherein the peripheral speeds of the developer carrier, the first developer supply member, and the second developer supply member are determined by numbers of teeth of the gears.

13. The development device according to claim 12, wherein the developer carrier includes a conductive shaft and an elastic layer.

14. The development device according to claim 12, wherein the developer supply members each include a conductive shaft and an elastic foam layer.

15. The development device according to claim 12, wherein a contact area of the second developer supply member with the developer carrier is set to be smaller than a contact area of the first developer supply member with the developer carrier.

16. The development device according claim 12, wherein the first and second developer supply members are configured to rotate in the same rotational direction.

17. The development device according claim 12, wherein the developer carrier is configured to rotate in a rotational direction same as those of the first and second developer supply members.

18. A development device comprising:

a developer carrier configured to carry a developer thereon;

a restriction member configured to restrict a layer thickness of the developer on a surface of the developer carrier; and first and second developer supply members being in contact with the developer carrier and each configured to rotate at a speed having a constant ratio to a rotation speed of the developer carrier, wherein the second developer supply member and the restriction member are arranged in this order downstream of the first developer supply member in a rotating direction of the developer carrier, and a peripheral speed of the second developer supply member is set to be slower than a peripheral speed of the first developer supply member, wherein the development device further comprises:

a first gear for the developer carrier;

a second gear for the first developer supply member;

a third gear for the second developer supply member; and idle gears, wherein the first, second, and third gears are connected with one another via the idle gears, wherein the gear of the developer carrier and the gear of the first developer supply member each comprises a two-stage gear configuration having two gears, wherein one of the two gears of the developer carrier and one of the two gears of the second supply member, whose numbers of the teeth are close to each other, are connected to each other.

19. An image formation apparatus comprising the development device according to claim 12.

20. The image formation apparatus according to claim 19, wherein the first developer supply member and the second developer supply member are each configured to receive a voltage and thereby charge the developer so as to supply the charged developer to the developer carrier by using a voltage difference between the developer carrier and the developer supply member, and the voltage applied to the second developer supply member is higher than the voltage applied to the first developer supply member.

21. The image formation apparatus according to claim 20, wherein the first developer supply member and a member configured to step down a voltage are electrically connected to each other in series and the second developer supply member and a set of the first developer supply member and the member configured to step down a voltage which are connected in series are electrically connected to each other in parallel, and the voltage applied to the second developer supply member is set to be higher than the voltage applied to the first developer supply member.

22. The image formation apparatus according to claim 21, wherein the member configured to step down a voltage is a voltage regulator diode.

23. An image formation apparatus comprising the development device according to claim 15.

* * * * *